United States Patent [19]

Hollowell et al.

[11] Patent Number: 4,702,037

[45] Date of Patent: Oct. 27, 1987

[54] SERVICE WINDOW

[76] Inventors: John R. Hollowell, 22179 Long Blvd., Dearborn, Mich. 48124; John F. Hollowell, 6526 Sharon Dr., Garden City, Mich. 48135

[21] Appl. No.: 891,745

[22] Filed: Jul. 30, 1986

[51] Int. Cl.[4] ..... E05F 17/00; E05D 7/08; E06B 3/00

[52] U.S. Cl. ..... 49/114; 49/356; 49/388; 49/394; 49/501

[58] Field of Search ..... 49/114, 109, 113, 118, 49/501, 388, 366, 394, 338, 356, 52, 775; 292/92, 288

[56] References Cited

U.S. PATENT DOCUMENTS

| | | | |
|---|---|---|---|
| 1,373,567 | 4/1921 | Overlien . | |
| 1,430,015 | 9/1922 | Icher . | |
| 1,512,791 | 10/1934 | Musselman . | |
| 2,151,587 | 3/1939 | Cassileth . | |
| 2,455,018 | 11/1948 | McKeown . | |
| 2,532,758 | 12/1950 | Carr . | |
| 2,569,624 | 10/1951 | Wychowaniec et al. . | |
| 2,601,604 | 6/1952 | Ford | 49/109 |
| 2,670,952 | 3/1954 | Bushell . | |
| 2,899,229 | 8/1959 | Jenks . | |
| 3,005,650 | 10/1961 | Schuessler et al. . | |
| 3,011,779 | 12/1961 | Reiter . | |
| 3,147,030 | 9/1964 | Berk . | |
| 3,256,637 | 6/1966 | Torrey . | |
| 3,780,472 | 12/1973 | Biebuyek | 49/501 |
| 3,914,965 | 10/1975 | Paxton . | |
| 4,082,334 | 4/1978 | Volta et al. . | |
| 4,105,232 | 8/1978 | Miels | 292/288 X |
| 4,411,102 | 10/1983 | Radek . | |
| 4,442,630 | 4/1984 | Radek . | |

OTHER PUBLICATIONS

"Ready Metal Drive-Thru Windows Price List", Ready Metal Manufacturing Company, Jan. 4, 1982.

"Ready Metal Drive-Thru Window", Ready Metal Manufacturing Company.

*Primary Examiner*—Philip C. Kannan

*Attorney, Agent, or Firm*—Harness, Dickey & Pierce

[57] ABSTRACT

The service window is constructed from a universal extruded framing member which can be cut to any desired window dimensions. A bell crank linkage with hip actuator or either of the pair of handles can be used to swing both doors open simultaneously about their respective vertical hinges. The bell crank linkage is mechanically efficient and space saving, and includes an automatic spring return mechanism. The handles are located over center with respect to the hinges. A U-shaped channel-formed member with wedge-shaped insert slips over the handles to prevent the window from being opened. The innermost edges of the handles confront the wedge insert to prevent the handles from following the arc trajectories followed during opening. These trajectories pass closest as they cross the plane between vertical hinges, thus, the wedge insert provides a solid, stable locking condition which is not readily jarred loose by vibration or prying.

41 Claims, 16 Drawing Figures

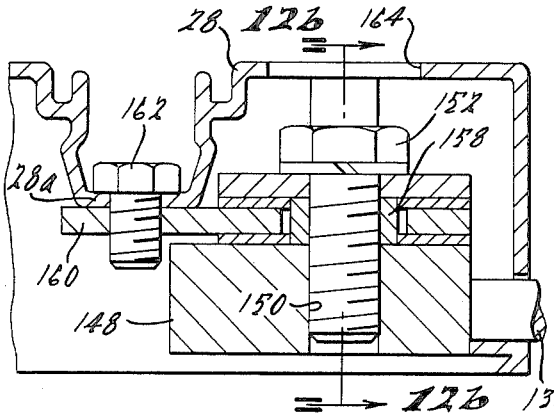
FIG. 12a.
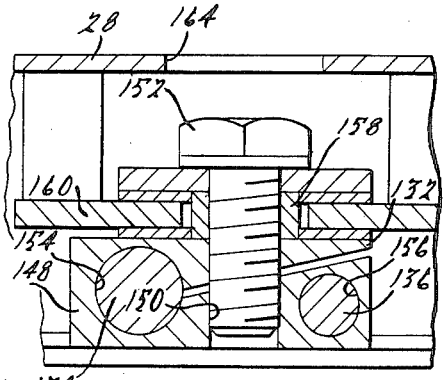
FIG. 12b.
FIG. 15.
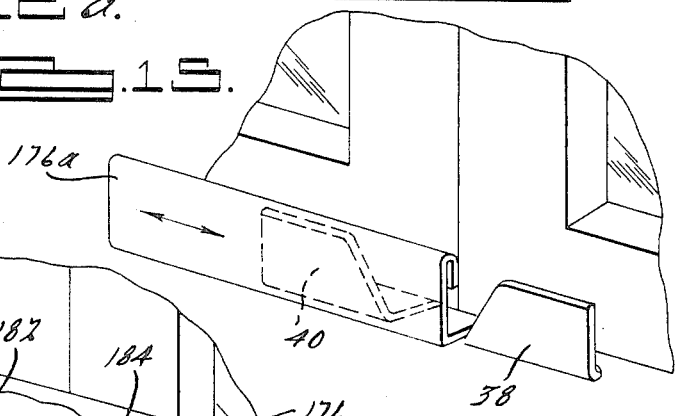
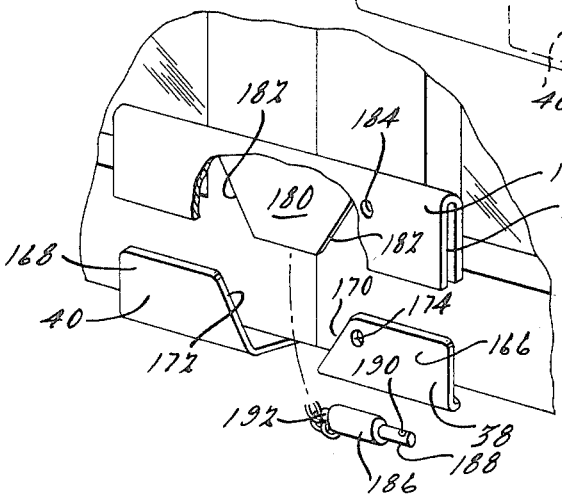
FIG. 13.
FIG. 14.
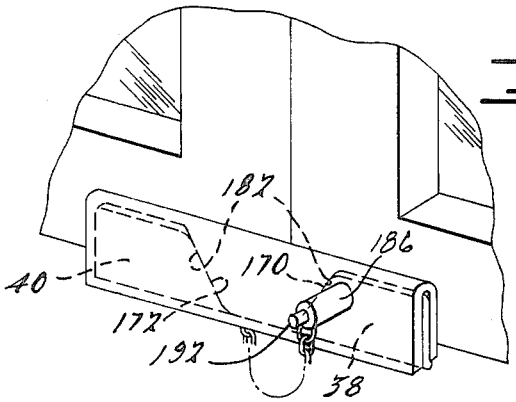

SERVICE WINDOW

BACKGROUND AND SUMMARY OF THE INVENTION

The present invention relates generally to service windows and doors, and more particularly to vertically hinged swinging windows and doors for use in providing drive-through and walk-up services. The invention has wide applicability to many drive-through operations, including drive-through banks, fast food restaurants, and the like.

Drive-through and walk-up services and merchandising are becoming increasingly popular with a number of different businesses such as banks, restaurant chains, and the like. In today's fast moving, mobile and automobile dependent society it is expected that increasing numbers of merchants will take advantage of drive-through and walk-up service facilities in order to better serve their customers and increase their business. Drive-through facilities are particularly appealing since indoor service counters and lobbies can then be made smaller and cheaper to maintain.

In the past, drive-through service windows have proven to be overly expensive, difficult to acquire in nonstandard sizes, and not readily adjustable to suit the physical size of the opening in the building. Some prefabricated service windows are available, primarily for use by fast food chains, although many such models employ complicated and relatively bulky window drive mechanisms and some protrude substantially from the exterior of the building, in bay window fashion causing architectural problems. Some prior art models place the window-operating mechanisms in a large compartment beneath the service counter which protrudes toward the outside of the building. Usually some form of metal cover or countertop is used to protect the mechanism from the elements. From the window attendant's viewpoint, this type of construction needs improvement, since the protruding compartment forces the attendant to lean and stretch in order to serve the customer on the other side of the countertop. Also, the need to guard against theft is a major consideration which has not heretofore been adequately dealt with. Some prior designs have required multiple locks, for example.

The present invention overcomes of the foregoing difficulties by providing a service window or door which is economical, readily fabricated into many sizes and shapes through the use of universal frame sections. In accordance with the invention, a generally rectangular frame is comprised of a plurality of frame sections, each section having first and second side walls and an exterior wall. The side walls and the exterior wall connect to define an internal space therebetween. A mounting flange extends from the exterior wall into the internal space and defines a first fastener receiving means. Second and third fastener receiving means are disposed respectively on the first and second side walls within the internal space. First and second interior walls are disposed respectively on the first and second side walls opposite the exterior wall. The interior walls are spaced apart to define a channel which communicates with the interior space. This channel is adapted to receive a generally planar rectangular panel, such as a pane of glass, which is supported in the channel of each of the frame sections. At least one hinge member having a pair of mounting holes in registration with the second and third fastener receiving means is provided. A first fastener means in the form of a pair of screws are passed through the mounting holes and into the second and third fastener receiving means for securing the hinge member to one of the frame sections. Preferably a pair of hinge members are secured in this fashion to each rectangular frame. In order to secure the frame sections together into a rectangular frame, at least one of the frame sections is provided with a mounting hole in registration with the first fastener receiving means of an adjacent frame section. A second fastener means in the form of a screw is passed through the mounting hole and into the first fastener receiving means for securing the frame section to its adjacent neighbor. Preferably a pair of opposing frame members are secured to the adjacent pair of opposing frame members in this fashion. The frame members may be extruded from aluminum and then cut to any desired length for use. In this fashion, the service window of the invention may be conveniently and economically fabricated to fit any required size and shape.

Further in accordance with the invention, the actuating mechanism comprises a bell crank linkage which causes both window panels to open outwardly, one panel with a clockwise rotation and the other panel with a counter clockwise rotation, in response to inwardly directed forces applied by the human operator upon a hip button. Optionally, the operator may open both panels by pushing either one outwardly. The bell crank linkage is disposed generally beneath the service counter and within a comparatively shallow support housing. The support housing protrudes from the exterior of the building as a narrow shelf and, therefore, makes it easy for the attendant to reach the customer.

The bell crank linkage employed is much simpler in operation than the mechanisms previously employed for this purpose. The linkage comprises a single interdependent linkage consisting of a relatively small number of moving parts which reduce the cost and potential for malfunctions. Another advantage of this simpler linkage system is the reduction of energy required to overcome the resistance necessarily incurred in a linkage consisting of numerous moving parts. This consideration is especially important considering the typical operator of service windows who tends to be a juvenile.

One embodiment of the service window of the invention also provides a convenient means for adjusting the window actuating lever to suit the physical size of the human operator. This is particularly useful where different work shifts use the same window during different times of the day. The window-actuating lever can be readily adjusted up or down to correspond to the hip height of the worker. In accordance with the invention, the service window comprises a window frame with first and second window panels vertically hinged to opposing sides of the frame for swinging movement between open and closed positions. A linkage means is provided for causing the panels to swing to the open position in response to forces applied by a human operator. The linkage means includes a lever pivotable about a generally vertical axis for receiving the human operator-applied forces and changing the direction of those forces. The lever is releasably secured for pivotal movement about a generally horizontal axis, whereby the height of the lever may be adjusted to suit the operator.

To further improve security, the invention provides a convenient and very effective locking mechanism which prevents the closed windows from being opened from the outside by prying. In accordance with the invention, first and second handle means are disposed respectively on the first and second panels adjacent the meeting edges of the panels. Each of the handles has a face portion disposed in a common generally vertical plane. A locking means comprising a rebent U-shaped channel or channel-forming lock is slidingly engageable with the face portions when the panels are in the closed positions. With the lock in place, the panels are prevented from swinging to the open position. The handle faces have opposing tapered edges, and the lock has a wedge member in the center of the channel. The wedge member is shaped to correspond to the negative space or empty space defined by and between the tapered edges of the face portions. When the lock is in place, the wedge member jams against the tapered edges of the face portions of both handles, which holds the handles together and keeps the handles from sliding in the channel. The handles are disposed in an offset relationship relative to the line between the hinges on opposing sides of the window, rendering the face portions of the handles over center with respect to the respective hinge points. This being the case, any rotational movement tending to open the windows causes the tapered edges of the face portions to be driven closer together, which movement is prevented by the wedge member. One of the handles is provided with a hole which registers with a corresponding hole in the lock, and a quick release pin or padlock may be inserted into the aligned holes to prevent the lock from being pried upwardly.

For a more complete understanding of the invention, its objects and advantages, reference may be had to the following specification and to the accompanying drawings.

BRIEF DESCRIPTION OF THE DRAWINGS

FIG. 3 is an exploded perspective view of the service window and frame of the invention with certain details of the actuated mechanism omitted;

FIGS. 12*a* and 12*b* (collectively referred to as FIG. 12) are partial cross-sectional views. FIG. 12*a* is taken along the line 12*a*—12*a* of FIG. 10, illustrating the hip button pivot mechanism in greater detail. FIG. 12*b* is a view taken along line 12*b*—12*b* of FIG. 12*a*.

FIG. 13 is a perspective view of the locking means of the invention shown in the unlocked position;

FIG. 14 is a similar view of the locking means of the invention shown in the locked position; and FIG. 15 is an alternate, sliding locking means.

DESCRIPTION OF THE PREFERRED EMBODIMENTS

Figure 1:
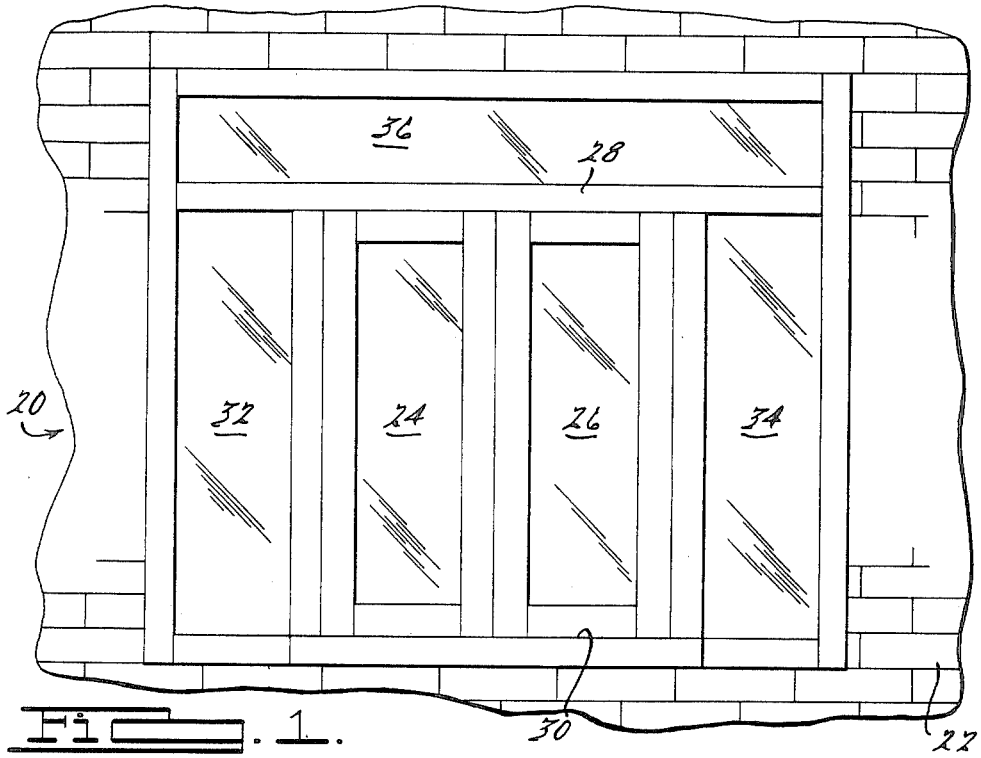
FIG. 1 is a front view of the service window of the invention as seen from the outside of a building.
Figure 2:
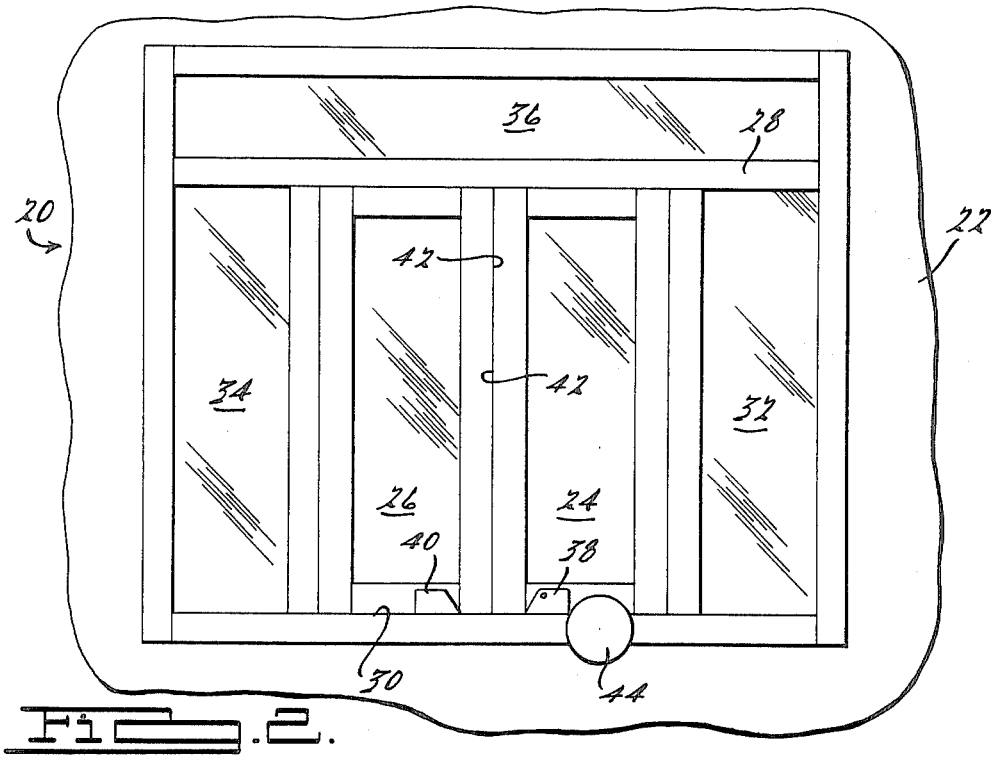
FIG. 2 is a rear view of the service window of the invention as seen from the inside of the building.
Figure 2:
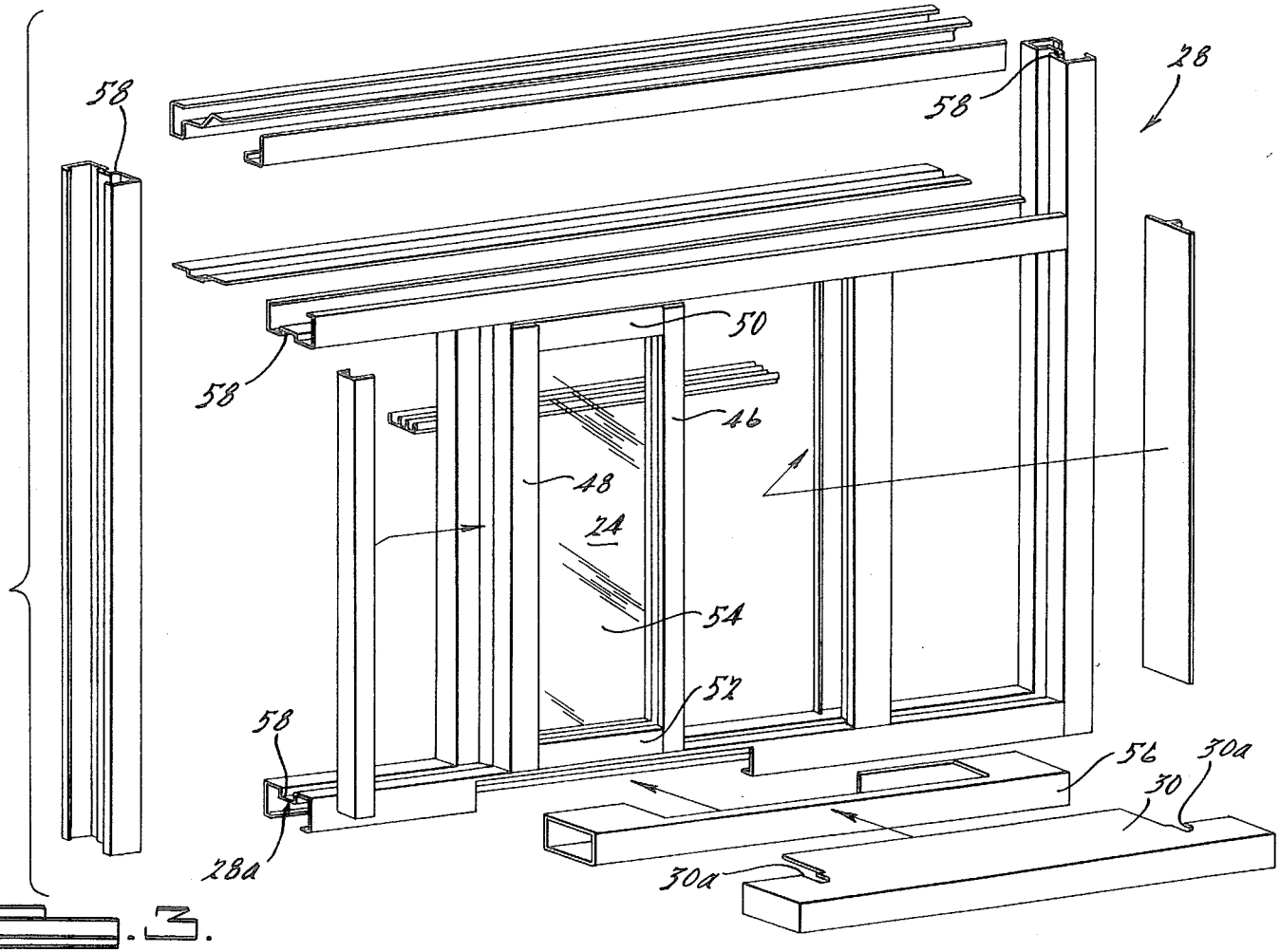

Referring to FIGS. 1 and 2, the service window of the invention is illustrated generally at 20 installed in building 22. Although the term "window" is used herein, it will be understood that the term "door" may be substituted therefor, and in general the invention is applicable to any opening in the wall of a building or other enclosure.

Service window 20 comprises first window panel 24 and second window panel 26 which are vertically hinged to opposing sides of window frame 28. The bottom horizontal portion of window frame 28 includes a service counter 30, and to the left and right and above window frame 28 there are auxiliary panels 32, 34 and 36, preferably of glass. Auxiliary panels 32 through 36 are optional, as the invention may be implemented without them. As seen in FIG. 2, window panels 24 and 26 are provided with handles 38 and 40 disposed along the bottom of panels 24 and 26, respectively, and in close proximity to the meeting edges 42. In one embodiment a hip button or pad 44 is also provided for opening the windows by depressing the button with the hips.

The service window is preferably constructed using extruded metal or bent metal components. FIG. 3 illustrates the components in exploded perspective view as seen generally from outside the building, with some components omitted for illustration purposes. For instance, window panel 26 has been omitted from FIG. 3. Also omitted is the window operating bell crank mechanism which will be discussed in detail below.

As seen in FIG. 3, window panel 24 includes inner vertical frame section 46, outer vertical frame section 48, upper horizontal frame section 50, and lower horizontal frame section 52. These frame sections enclose a pane of glass 54. Although not shown, it will be understood that second window panel 26 is constructed in essentially the same way.

The service window of the invention further comprises a linkage support housing 56 which is disposed generally beneath the window panels 24 and 26. The linkage support housing supports and encloses the window-actuating mechanism (not shown) which will be discussed below. Service counter member 30 slidably nests around linkage support housing 56 to protect the window-actuating mechanism and to obscure it from view. Preferably service counter 30 is fashioned from stainless steel to provide a durable, corrosion-resistant counter top and has slots 30*a* to accommodate the window hinges. The hinges (discussed below) have hinge pins which are spaced wider than the window opening so that counter member 30 can be slidably horizontally moved into its nesting position.

The remaining components illustrated in FIG. 3 comprise the window frame 28. These components are formed with the cross-sectional configurations shown in order to achieve a strong window frame with the appropriate channels, such as channels 58 for receiving and supporting the auxiliary panels 32, 34 and 36 (not shown).

Figure 4:
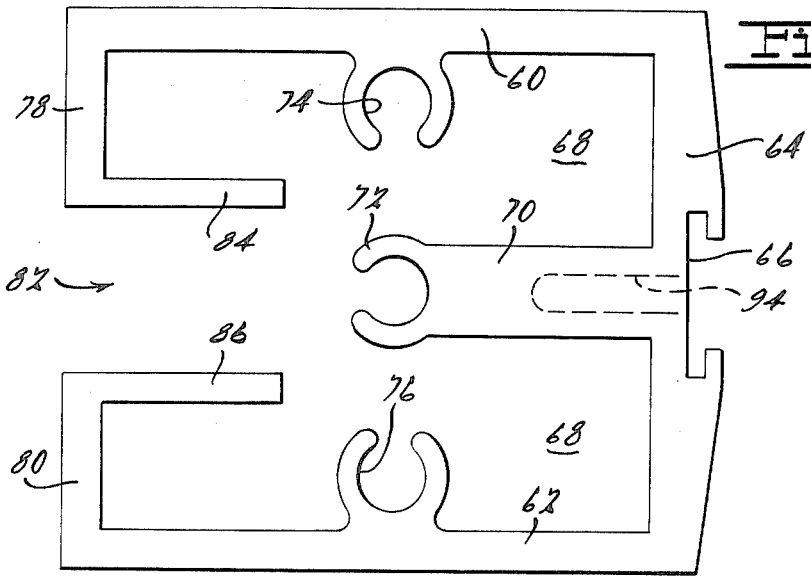
FIG. 4 is a cross-sectional view of the extruded frame member used to construct the service window of the invention.

Referring now to FIG. 4, the cross section of one of the frame sections comprising window panel 24 is shown. Preferably both window panel 24 and 26 are constructed of extruded aluminum stock having the cross section shown in FIG. 4. In other words, the frame sections 46, 48, 50 and 52 are constructed from stock having the cross section shown in FIG. 4. The frame section includes first side wall 60, second side wall 62, and exterior wall 64. Exterior wall 64 is tapered at its outer extremities relative to its middle, so the doors will open and close with adequate swinging clearance, and includes an elongated slotted keyway 66 for slidably receiving a weather strip. Side walls 60 and 62 and exterior wall 64 connect to one another to define an internal space 68 therebetween. A mounting flange 70 extends from the exterior wall 64 into interior space 68, preferably along the line of symmetry midway between walls 60 and 62. Flange 70 is thick enough to accommodate a threaded aperture or mounting hole 94 used to secure an adjacent frame section as will be described below. A first fastener receiving slot 72 is formed on the end of mounting flange 70. Second and third fastener receiving slots 74 and 76 are disposed respectively on first and second side walls 60 and 62 within internal space 68. Preferably the fastener receiving slots and mounting flange 70 extend the entire length of the frame section so that the section may be fabricated by extrusion. Slots 72, 74, and 76 are sized to receive self-tapping sheet metal screws and have centers which preferably lie on a common straight line and are centered on the extrusion.

The frame section further comprises first interior wall 78 and second interior wall 80, which connect to and extend at right angles from side walls 60 and 62. As shown, interior walls 78 and 80 are positioned opposite and roughly parallel to exterior wall 64. Thus, the cross section of the frame section is generally rectangular. Interior walls 78 and 80 are spaced apart to define a channel 82 which communicates with interior space 68. Interior walls 78 and 80 are respectively provided with inward flanges 84 and 86 which extend into internal space 68 at right angles to interior walls 78 and 80. Inward flanges 84 and 86 are generally parallel to one another and provide opposing supporting surfaces for capturing and holding a trimmed glass panel (not shown).

Figure 5:
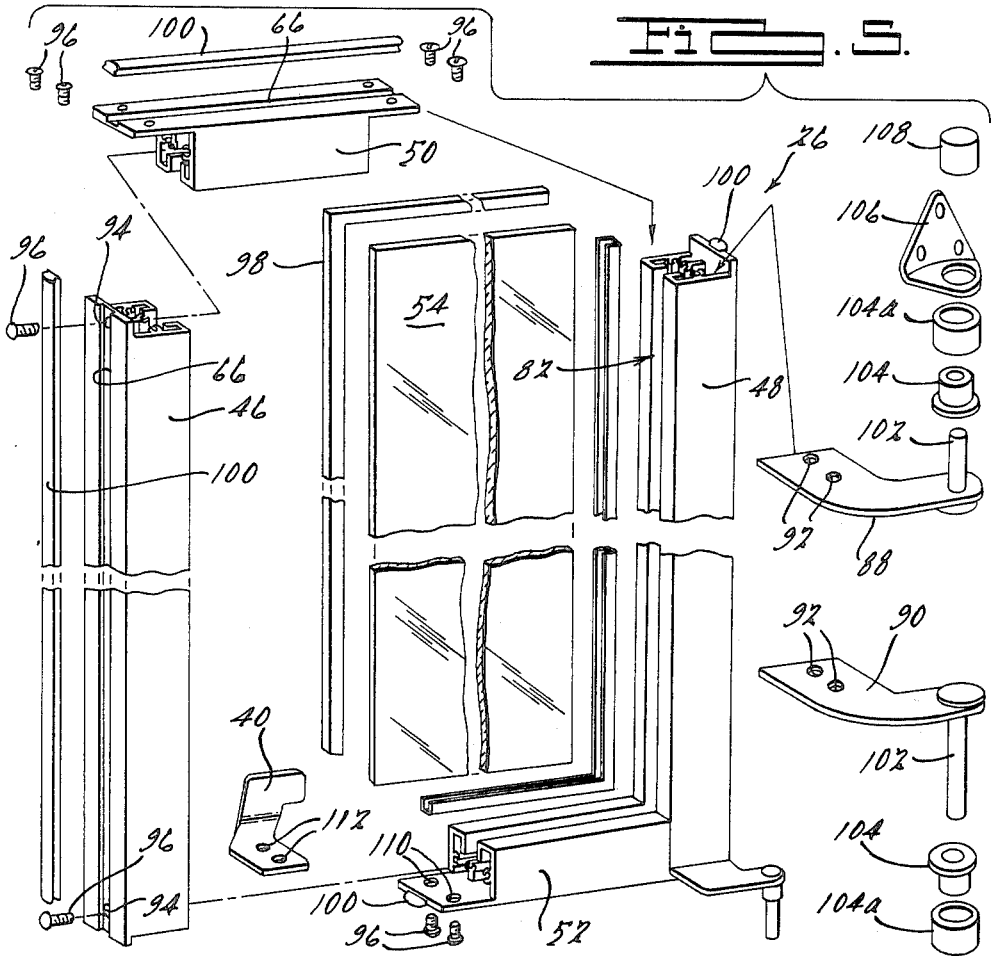
FIG. 5 is an exploded perspective view of a portion of the right hand service window as seen from the outside, showing the hinge and window construction.

A more detailed understanding of the window construction of the invention may be had with reference to FIG. 5 which depicts the right hand window 26 as seen generally from the outside. When referring back to FIG. 3, it should be noted that FIG. 3 depicts the left hand window 24 as seen from the outside (the right hand window having been deleted in that view). Referring to FIG. 5, the manner in which frame sections 46, 48, 50, and 52 are secured to one another and to the upper and lower hinge members 88 and 90 is shown. As illustrated, the entire assembly of frame members, hinges and handles all screw together into an integral and solid assembly using the same mounting screws. The notched construction of frame section joints holds hinge members and handles more firmly than if screwed to a surface due to the mortise and tenon-type effect. Mitered frames can also be constructed using the frame section of the invention. It will be understood that second and third fastener receiving slots 74 and 76 align with hinge mounting holes 92, while first fastener receiving slot 72 aligns with vertical frame section mounting holes 94. Self-tapping sheet metal screws 96 are used to secure the hinge members 88 and 90 to the outer vertical frame section 48 and also to secure both vertical frame sections 46 and 48 to the upper and lower horizontal frame sections 50 and 52. As illustrated, glass pane 54 is trimmed with edge trim strip 98. Trim strip 98 is sized to slidably fit within channel 82 to hold the pane firmly in place. To ensure that the window panel fits tightly in the window frame 28, weather stripping 100 is slidably inserted into slotted keyway 66 on all four sides of the window panel. As an added benefit, weatherstripping 100 hides the horizontal screws and the horizontal weatherstripping is held in place by the tabs formed by the vertical sections. Hinge members 88 and 90 are provided with hinge pins 102, which in turn carry bushing 104 and spacer **104*a* assemblies, hinge bracket 106, and end cap 108. Hinge pin 102 of lower hinge member 90 has similar bushing 104 and spacer 104*a* assembly; however, the lower hinge pin is longer so that end of this hinge pin projects below bushing and spacer for connecting to the window actuating mechanism discussed below in connection with FIG. 6. If desired, the bushing and spacer assemblies may be fabricated as a one-piece unit. As illustrated, handle 40 is secured to lower horizontal frame section 52 by means of screws 96 extending through mounting holes 110 and 112, for securing in the fastener receiving slots 74 and 76 of inner vertical frame section 46. The same screws also serve to hold inner vertical frame section 46 and lower horizontal frame section 52 together. Because of the geometry of the extruded frame section, the horizontal and vertical mounting screws 96** lie in different planes and thus miss each other.

Figure 6:
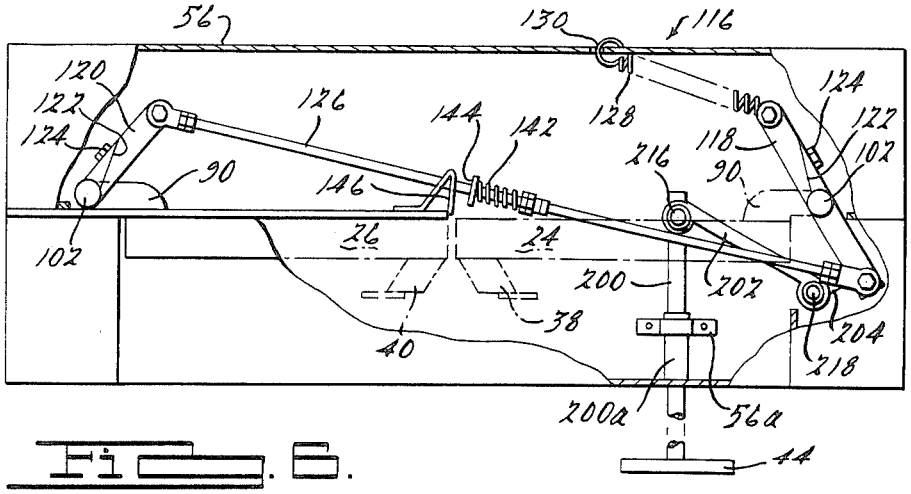
FIG. 6 illustrates the presently preferred hip-actuated embodiment of the actuator mechanism of the invention.

The presently preferred window-actuating mechanism is illustrated generally at 116 in FIG. 6. Also shown in FIG. 6 is linkage support housing 56 which was illustrated and discussed in connection with FIG. 3 above. The window-actuating mechanism is adapted to for coupling to the hinge pins 102 of lower hinge members 90. Window-actuating mechanism 116 comprises a bell crank arrangement. The hinge pin of one of the lower hinge members is secured in lever 118 while the hinge pin of the other lower hinge member is secured in lever 120. As illustrated, both levers have a slot 122 and clamping bolt 124 for tightly clamping onto the hinge pins 102. Levers 118 and 120 are connected through tie rod 126 at the ends thereof, and lever 118 is also coupled through spring 128 to a stationary point 130 on the linkage support housing 56. Tie rod 126 is provided with an adjustable spring-loaded stop 142 which is carried concentrically about tie rod 126 and has a foot 144 which contacts stop bracket 146 to cushion the operation of the actuating mechanism. The window-actuating mechanism operates to transmit clockwise rotation to one of the windows and counter clockwise rotation to the other of the windows simultaneously. Thus, by pushing on the handle of either one of the windows, both windows will open together. The bushing 104 and spacer **104*a* assemblies are supported by the linkage support housing 56. The hinge pins are journaled for rotation in the bushing spacer assemblies, with the spacer 104 serving as a spacer to space the hinge member above the sill or counter top 30** with sufficient clearance to allow the hinge member to swing freely.

In addition to being operable by hand pressure on either of the handles, the actuating mechanism is also operable by hip pressure upon hip button 44. Button 44 acts through push rod 200 which is in turn articulated or pivotally connected as at 216 to elongated, one-piece connecting arm 202. Arm 202 is in turn articulated or pivotally connected as at 218 to an extension lever 204, which is preferably a one-piece extension of, or rigidly attached to, the hinge actuating lever 118. Push rod 200 slides in and out within bushing **200*a* which is clamped to housing 56 as at 56*a***.

By depressing hip button 44 inwardly, push rod 200 causes journal point 216 to move inwardly, drawing connecting arm 202 inwardly and in a generally clockwise trajectory (as viewed in FIG. 6) about the axis of hinge pin 102 associated with window 24. The motion of connecting arm 202 thus causes lever 118 to rotate in a clockwise fashion about the axis of hinge pin 102, thereby opening the windows against the return bias force of spring 128. The geometry and relationship of the push rod, connecting arm, extension lever and lever 118 and hinge pin are such that the windows open slowly at first and then gradually more rapidly as the hip button is depressed. This has the effect of sinisoidally distributing the force applied to the hip button, so that it takes comparatively lower force to commence window opening from its rest position than the force to continue opening after the window has opening momentum.

Figure 7:
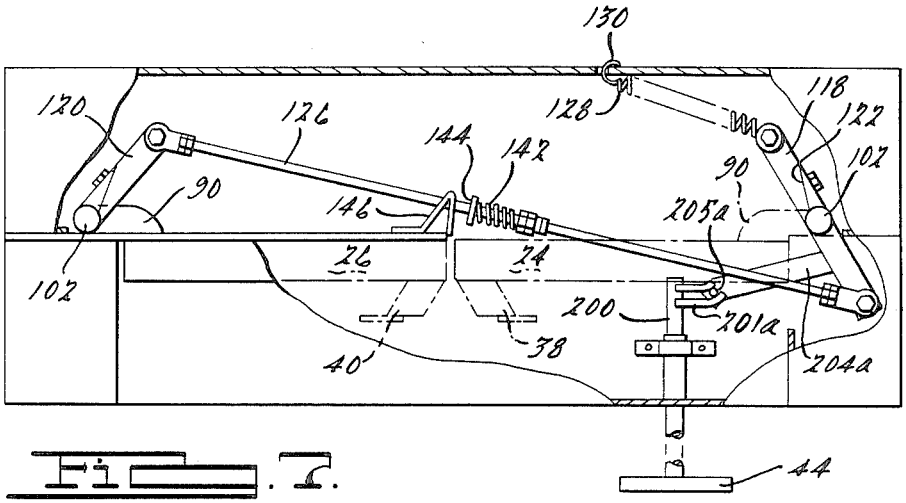
FIGS. 7, 8 and 9 illustrate alternate hip-actuated embodiments.
Figure 8:
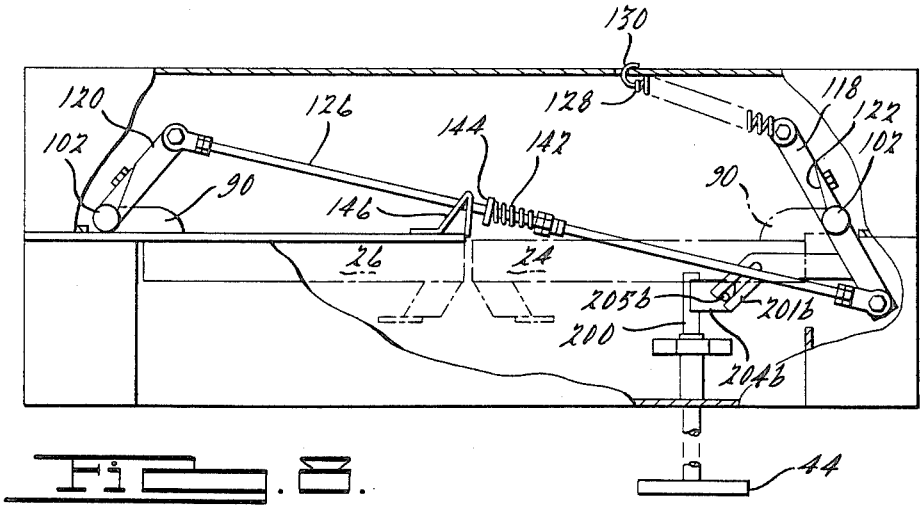

FIGS. 7 and 8 illustrate alternate embodiments of window-actuating mechanism which may be operated either by hand pressure upon handles 38 and 40 or by hip pressure upon hip button 44. By comparing FIGS. 7 and 8 with FIG. 6, it will be seen that many elements are common to both linkage mechanisms. The common elements bear like reference numerals. The primary difference between the embodiment of FIG. 6 and those of FIGS. 7 and 8 is the structure for communicating and translating motion of push rod 200 into motion of lever 118. In the embodiment of FIG. 7, push rod 200 is provided with a slot-forming fork structure 201*a*. Lever 118 is provided with a rigid extension 204*a* which carries a pin 205*a*. Pin 205*a* rides in the slot formed by fork 201*a* to transfer motion of the push rod to lever 118.

The embodiment of FIG. 8 is similar to that of FIG. 7, with push rod 200 being provided with a rigid extension 204*b*, carrying pin 205*b*, which rides in the slot formed by fork structure 201*b* rigidly attached to lever 118.

Figure 9:
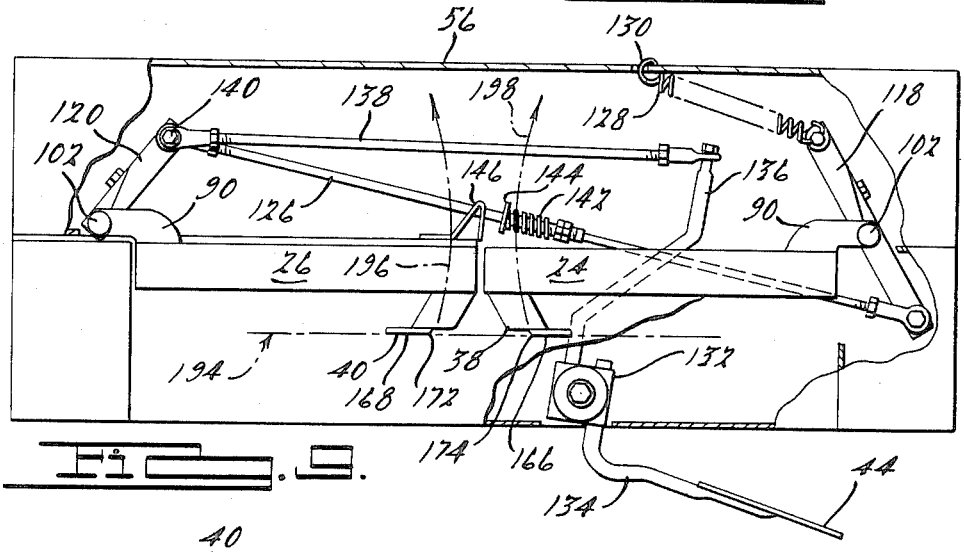
Figure 10:
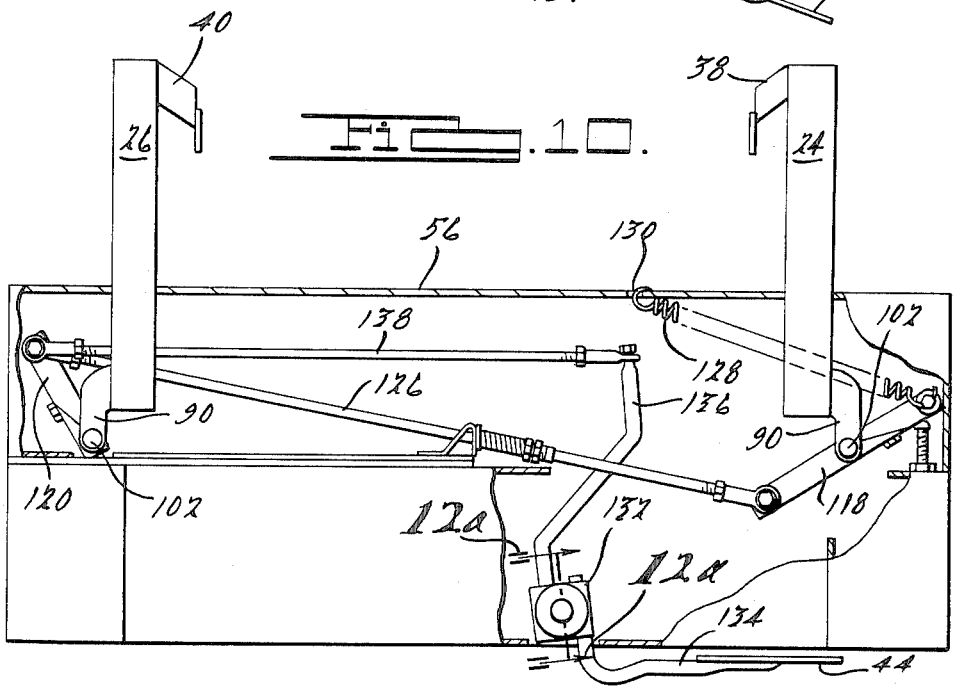
FIG. 10 illustrates the embodiment of FIG. 9 showing the windows in the open position.

Yet another embodiment is illustrated in FIGS. 9, 10 and 12, with common elements bearing like reference numerals. This embodiment is characterized by a somewhat different actuator mechanism. Referring to FIGS. 9 and 10, the mechanism comprises a pivot mechanism 132 which is secured to the underside of the window frame 28 as will be discussed below in connection with FIG. 12. A lever arm 134 is connected to pivot mechanism 132 and in turn carries the hip button or pad 44. Connected to pivot mechanism 132 is a doubly bent first linkage or rebent arm 136 which is in turn connected to a straight second tie rod or linkage 138. Linkage 138 is pivotally connected at 140, to which tie rod 126 is also pivotally connected. In this embodiment, tie rod 126 is also provided with an adjustable spring loaded stop 142 which is carried concentrically about tie rod 126 and has a foot 144 which contacts stop bracket 146 to cushion the operation of the actuating mechanism. FIG. 10 illustrates the actuating mechanism of FIG. 9 and the windows 24 and 26 in the open position. It will be understood that this position may be attained by either depressing hip button 44 or by manually swinging handles 38 or 40 outwardly. When pressure on hip button 44 and the handles is removed, spring 128 returns the actuating mechanism and windows to the closed position shown in FIG. 9.

Referring now to FIG. 12, pivot mechanism 132 is seen to include a generally rectangular slotted block 148 which has a vertical hole 150 for receiving bolt 152 and which also has a pair of horizontal holes 154 and 156. Hole 154 receives the end of lever arm 134 and the diameter of hole 154 may be adjusted to loosen or clamp lever arm 134 by loosening and tightening bolt 152. Hole 156 is adapted to receive first linkage 136. The slotted block 148 is carried by bolt 152 and bushing 158 on a mounting plate 160. Mounting plate 160 is in turn attached as with screws or bolts 162 to the underside of window frame 28, preferably to the central portion 28*a* thereof which forms channel 58 (shown in FIG. 3). Access to bolt 152 may be had through access opening 164. By loosening bolt 152, the size of hole 154 increases as the slotted block 148 is restored to its initial nondeformed condition. This permits lever 134 to be pivotally adjusted about a generally horizontal axis in order to adjust the height of the hip button to suit the human operator. Once the height is selected, bolt 152 is tightened, deforming slotted block 148 by drawing the block together and thereby diminishing the size of hole 154. Slotted block 148 is pivotal about the generally vertical axis upon bushing 158. The entire window-actuating mechanism 114, including lever 134, slotted block 148, linkages 136 and 138, levers 120 and 122 and tie rod 138 all serve to change or redirect the direction or forces applied to hip button or pad 44 into the respective clockwise and counter clockwise rotations needed to open and close windows 24 and 26.

Figure 11:
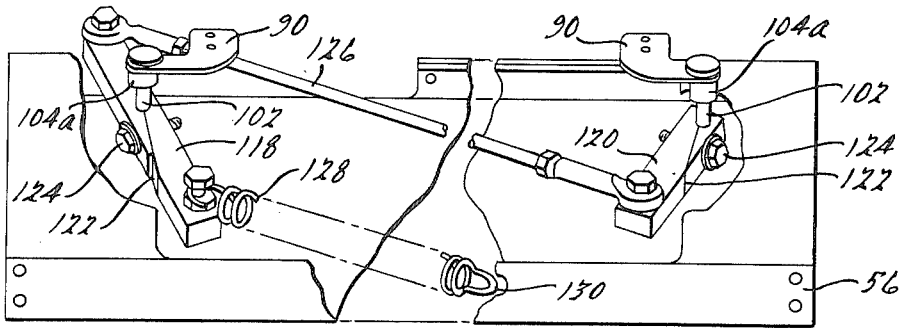
FIG. 11 illustrates a hand-operated embodiment of the actuating mechanism of the service window.

If hip actuation is not required, the invention may be implemented without it. FIG. 11 illustrates how this may be accomplished. Like elements have been given like reference numerals as used in the other figures. Note that FIG. 11 is a fragmentary perspective view looking generally from outside the building and downwardly.

The locking mechanism of the invention is illustrated in FIGS. 13, 14 and 15. As best seen in FIG. 13, handles 38 and 40 include generally vertically extending face portions 166 and 168. Face portions 166 and 168 lie generally in a common plane and both face portions have opposing inclined edges 170 and 172. Face portion 166 is also provided with a locking hole 174. A rebent U-shaped member or lock 176 is used to lock the windows in the closed position. Rebent lock 176 defines a narrow elongated channel 178 with a trapezoidal-shaped wedge member 180 spot welded or otherwise secure within channel 178 generally midway between the ends of lock 176. Wedge member 180 has angled edges 182 which are disposed at the same angle with respect to the horizontal as inclined edges 170 and 172 are disposed. Wedge member 180 is of sufficient width so that when lock 176 is slidably engaged over handles 40 and 38, as shown in FIG. 11, the angled edges 182 contact inclined edges 170 and 172 with a wedging action. Lock 176 is also provided with a locking hole 184, and when lock 176 is slidably engaged over handles 38 and 40, locking holes 174 and 184 register. The locking means further includes a locking pin 186 which has an elongated end 188 for insertion into locking holes 174 and 184. The end is also furnished with a ball retainer 190 which may be either spring loaded to create a snap action as the ball retainer passes through the locking holes, or alternatively the ball retainer may be of the type which is extended or retracted in response to pressure applied on a plunger 192 in the opposite end of the locking pin. As an example of a suitable locking pin, reference may be had to U.S. Pat. No. 3,914,965. If desired, a lock may be used in place of the locking pin for greater security.

To understand the operation of the locking mechanism of the invention, reference may be had to FIG. 9. As seen in FIG. 9, face portions 166 and 168 of handles 38 and 40 lie in a common, generally vertical plane denoted by dashed line 194. As the windows are swung open, the inclined edges 170 and 172 follow the arc-shaped trajectory denoted by dashed lines 196 and 198. As will be seen by viewing the arcs, edges 170 and 172 must actually pass closer together as the window panels are swung open. However, with wedge member 180 (not shown in FIG. 7) of lock 176 in place, the handles are prevented from following the arc-shaped trajectory and hence both window panels are firmly prevented from being opened. The locking pin 186 prevents lock 176 from being removed from the outside by attempting to insert a knife blade or screwdriver between the crack between window panels 24 and 26 and tapping the bracket out of position. Thus, the locking mechanism of the invention prevents the windows from being opened from the outside and rigidly secures the windows together so that no amount of rattling from the outside will loosen the locking mechanism.

FIG. 15 illustrates an alternate locking system which employs a slider-type lock 176*a* which remains on one of the handles (e.g. handle 40) at all times during use throughout the day. Lock 176*a* is slid to one side to disengage the other handle (e.g. handle 38) when opening the windows. Lock 176*a* is slid to engage both handles to lock the window. If desired, lock 176*a* can be removed and replaced with previously described lock 176 for more secure nighttime use.

While the invention has been described in its presently preferred embodiments, it will be understood that the invention is susceptible to modification and change without departing from the scope of the invention as defined in the claims set forth below.

What is claimed is:

1. A service window construction comprising:

a generally polygonal frame comprising a plurality of frame sections, each frame section having first and second side walls and an exterior wall, said side walls and said exterior wall connecting to define an internal space therebetween;

first and second interior walls disposed respectively on said first and second side walls opposite said exterior wall, said interior walls being spaced apart to define a channel extending into said internal space;

a mounting flange extending from one of said walls into said internal space and defining a first fastener receiving means;

second fastener receiving means disposed on one of said walls within said internal space;

a generally planar polygonal panel supported in said channel of each of said frame sections;

at least one hinge member having a first mounting means having a first aperture in registration with one of said fastener receiving means of a first one of said frame sections;

a second one of said frame sections having a second mounting means having a second aperture in registration with said first aperture;

said first and second apertures and said one of said fastener receiving means receiving a first fastener for securing said hinge member to said first and second frame sections and also for securing said first and second frame sections together.

2. The window construction of claim 1 wherein said polygonal frame comprises a generally rectangular frame and wherein said polygonal panel comprises a generally rectangular panel.

3. The window construction of claim 1 wherein said mounting flange extends from said exterior wall.

4. The window construction of claim 1 wherein said second fastener receiving means is disposed on one of said side walls and said window construction further comprises a third fastener receiving means disposed on the other of said side walls.

5. The window construction of claim 1 wherein said frame sections have a substantially uniform cross section throughout substantially the entire length thereof.

6. The window construction of claim 1 further comprising third fastener receiving means disposed on one of said side walls within said external space and wherein said first, second, and third fastener receiving means are each secured to a different one of said walls.

7. The window construction of claim 1 further comprising slotted key way means disposed in said exterior wall and weather stripping member secured in said slotted key way.

8. The window construction of claim 1 further comprising third fastener receiving means disposed on one of said walls within said internal space and wherein said first, second, and third fastener receiving means are disposed generally along a common line.

9. The window construction of claim 1 wherein said mounting flange extends from said exterior wall and along a line of bilateral symmetry.

10. The window construction of claim 1 wherein said channel communicates with said internal space and wherein said first and second interior walls each include opposing inward flanges for capturing said panel.

11. A service window comprising:

a window frame;

first and second window panels vertically hinged to opposing sides of said frame for swinging movement between open and closed positions;

linkage means for causing said panels to swing to said open position in response to forces applied by a human operator; and said linkage means including lever means pivotable about a generally vertical axis for receiving said human-applied forces and for changing the direction of said forces, said lever means being releasably secured for pivotal adjustment about a generally horizontal axis, whereby the height of said lever means may be adjusted to suit the human operator.

12. The service window of claim 11 wherein said linkage means includes a compression spring means for retarding the swinging movement of said panels when swung to said open position.

13. The service window of claim 11 wherein said linkage means comprises a bell crank means.

14. The service window of claim 11 further comprising:

mounting block means carried on said window frame, said block means having a means for coupling to said linkage and further having a horizontally disposed hole for receiving said lever means, said block means having a slot extending from said hole to the exterior of said block means and having a means for deforming said block means in a direction generally perpendicular to said slot, wherein said slot and said hole cooperate to provide a means for releasably securing said lever means.

15. The service window of claim 11 further comprising spring means for biasing said window panels toward said closed position.

16. The service window of claim 11 wherein said first and second window panels each include at least one hinge pin means and wherein said linkage means includes means for coupling said human-applied forces through said hinge pin means.

17. The service window of claim 16 further comprising first and second bell crank lever means clampingly secured to said hinge pin means for imparting axial rotating movement to said hinge pin means.

18. A service window comprising:

a window frame;

first and second window panels vertically hinged to opposing sides of said frame for swinging movement between open and closed positions, said panels having generally meeting edges when in said closed position;

first and second handle means disposed respectively on said first and second panels adjacent said meeting edges, said handles each having a face portion;

locking means comprising a U-shaped channel-forming member for slidingly engaging said face portions when said panels are in said closed position to thereby prevent said panels from swinging to said open position.

19. The service window of claim 18 wherein said handles each define opposing edges and wherein said bracket includes a wedge means disposed in said channel, said wedge means being constructed and arranged to engage both of said opposing edges when said bracket slidingly engages said face portions.

20. The service window of claim 18 further comprising pin and aperture means on said bracket means and on at least one of said handle means for locking said bracket means in said face portion engaging position.

21. The service window of claim 18 wherein said face portions are disposed in a common plane.

22. The service window of claim 18 wherein said face portions are disposed in a generally vertical common plane.

23. The service window of claim 18 wherein said locking means includes a wedge means disposed in said channel for contacting said first and second handle means when said bracket means is slidingly engaged with said portions.

24. The service window of claim 18 wherein said window panels are pivotable about a pair of axes which define a plane therebetween and wherein said face portions are laterally offset from said plane when in said closed position, such that said face portions must pass through said plane upon being swung to said open position.

25. The service window of claim 18 wherein said panels are rotatable about a pair of axes which define a plane therebetween and wherein said face portions are laterally offset from said plane when in said closed position and wherein said handles define a pair of opposing edges.

26. The service window of claim 25 wherein said opposing edges are over center with respect to said axes.

27. A service window comprising:

a window frame;

first and second window panels secured to said frame for rotation about first and second generally vertical hinges between open and closed positions;

first hinge actuator secured to said first hinge for rotation with said hinge about a common axis with said first hinge;

second hinge actuator secured to said second hinge for rotation with said hinge about a common axis with said second hinge;

rigid tie rod connector between said first and second hinge actuators for translating rotation of said first hinge into counterrotation of said second hinge;

push rod extending generally outwardly from the plane of said panels when in said closed position for receiving window-actuating forces;

direction changing linkage means coupled between said push rod and said first hinge actuator for translating said window-actuating forces into rotational movement of said first hinge;

wherein said direction changing linkage means comprises a one piece pivot member articulated to said push rod means at a first point on said pivot member; and an extension bar means rigidly secured to said first hinge actuator and articulated to said pivot member at a second point on said pivot member whereby displacement of push rod causes rotational movement relative to said second point.

28. The service window of claim 27 wherein said extension bar means is non-pivotably secured to said first hinge actuator.

29. The service window of claim 27 wherein said tie rod includes a compression spring means for retarding the swinging movement of said panels when swung to said open position.

30. The service window of claim 27 further comprising resilient member means for biasing said window panels towards said closed position.

31. The service window of claim 27 wherein said direction changing linkage means further comprises:

a non-pivotably secured protrusion extending from said first hinge actuator;

a member having first and second nonintersecting points whereby said member is articulated to said protrusion at said first point and articulated to said push rod at said second point.

32. A service window construction comprising:

a generally polygonal frame comprising a plurality of frame sections, each frame section having first and second side walls and an exterior wall, said side walls and said exterior wall connecting to define an internal space therebetween;

first and second interior walls disposed respectively on said first and second side walls opposite said exterior wall, said interior walls being spaced apart to define a channel extending into said internal space;

a mounting flange extending from one of said walls into said internal space and defining a first fastener receiving means;

second fastener receiving means disposed on one of said walls within said internal space;

a generally planar polygonal panel supported in said channel of each of said frame sections;

at least one hinge member having a first mounting means having a first aperture in registration with one of said fastener receiving means of a first one of said frame sections;

a second one of said frame sections having a second mounting means having a second aperture in registration with said first aperture;

said first and second apertures and said one of said fastener receiving means receiving a first fastener for securing said hinge member to said first and second frame sections and also for securing said first and second frame sections together;

said first one of said frame sections having a third aperture in registration with one of said fastener receiving means of said second one of said frame sections; and said third aperture and said one of said fastener receiving means of said second one of said frame sections receiving a second fastener for further securing said first and second frame sections together.

33. The window construction of claim 32 wherein said polygonal frame comprises a generally rectangular frame and wherein said polygonal panel comprises a generally rectangular panel.

34. The window construction of claim 32 wherein said mounting flange extends from said exterior wall.

35. The window construction of claim 32 wherein said second fastener receiving means is disposed on one of said side walls and said window construction further comprises a third fastener receiving means disposed on the other of said side walls.

36. The window construction of claim 32 wherein said frame sections have a substantially uniform cross section throughout substantially the entire length thereof.

37. The window construction of claim 32 further comprising third fastener receiving means disposed on one of said side walls within said external space and wherein said first, second, and third fastener receiving means are each secured to a different one of said walls.

38. The window construction of claim 32 further comprising slotted key way means disposed in said exterior wall and weather stripping member secured in said slotted key way.

39. The window construction of claim 32 further comprising third fastener receiving means disposed on one of said walls within said internal space and wherein said first, second, and third fastener receiving means are disposed generally along a common line.

40. The window construction of claim 32 wherein said mounting flange extends from said exterior wall and along a line of bilateral symmetry.

41. The window construction of claim 32 wherein said channel communicates with said internal space and wherein said first and second interior walls each include opposing inward flanges for capturing said panel.

* * * * *